US005799228A

United States Patent [19]

Iwata et al.

[11] Patent Number: 5,799,228

[45] Date of Patent: Aug. 25, 1998

[54] IMAGE FORMING APPARATUS WHICH PREVENTS ADVERSE AFFECTS FROM HEATING ELEMENTS

[75] Inventors: Nobuo Iwata, Kanagawa-ken; Shingo Katoh, Yokohama; Yutaka Shio, Yokohama; Tomonori Yabuta, Yokohama, all of Japan

[73] Assignee: Ricoh Company, Ltd., Tokyo, Japan

[21] Appl. No.: 661,116

[22] Filed: Jun. 10, 1996

[30] Foreign Application Priority Data

Jun. 9, 1995 [JP] Japan ..... 7-168226

[51] Int. Cl.[6] ..... G03G 15/01

[52] U.S. Cl. ..... 399/94; 399/43; 399/227

[58] Field of Search ..... 399/227, 53, 119, 399/226, 236, 27, 36, 263, 127, 94, 128, 43

[56] References Cited

U.S. PATENT DOCUMENTS

| | | | |
|---|---|---|---|
| 4,330,199 | 5/1982 | Komori et al. | 399/127 |
| 4,515,465 | 5/1985 | Miyoshi et al. | 399/127 X |
| 4,797,707 | 1/1989 | Iwahashi et al. | 399/128 |
| 5,565,973 | 10/1996 | Fujishiro et al. | 399/227 |
| 5,617,198 | 4/1997 | Ishikawa et al. | 399/27 |

FOREIGN PATENT DOCUMENTS

| | | |
|---|---|---|
| 61-090172 | 5/1986 | Japan . |
| 2-150870 | 6/1990 | Japan . |
| 2-248967 | 10/1990 | Japan . |
| 6-258905 | 9/1994 | Japan . |
| 8-6399 | 1/1996 | Japan . |

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

An image forming apparatus includes a revolver type developer, and prevents toner stored within the revolver type developer from being adversely influenced by heat from a fixing unit. As one feature, the revolver developing unit is intermittently rotated when the image forming apparatus is in a stand-by state. As a further feature, the revolver developing unit is rotated at a very slow continuous speed when the image forming apparatus is in a stand-by state. As a further feature, the intermittent rotation and the slow continuous rotation of the revolver developing unit can be stopped if the temperature of the fixing unit falls below a predetermined value.

19 Claims, 11 Drawing Sheets

IMAGE FORMING APPARATUS WHICH PREVENTS ADVERSE AFFECTS FROM HEATING ELEMENTS

BACKGROUND OF THE INVENTION

1. Field of the Invention

The present invention is directed to an image forming apparatus with a control which prevents heating elements in the image forming apparatus from adversely affecting toner stored in the image forming apparatus.

2. Discussion of the Background

Image forming apparatuses are known which utilize a revolver developing unit. FIG. 12 shows elements of such a background image forming apparatus. In such an apparatus, a revolver developing unit 4 includes a plurality of toner cartridges 42Y, 42K, 42M and 42C, each storing toner of a different respective color, for example, yellow, black, magenta and cyan. Such a revolver developing unit 4 includes individual respective developing units 22Y, 22K, 22M and 22C. Furthermore, in such an image forming apparatus a fixing unit 7 which includes a fixing roller 7*a* and a pressure roller 7*b* is provided.

In this type of device, after an image is formed on a transfer medium, such as a sheet of paper, the transfer medium is passed between the fixing roller 7*a* and the pressure roller 7*b*, and the image on the transfer medium is fixed thereon. This fixing operation is performed by heat, and a heater is included in at least one of the fixing roller 7*a* or the pressure roller 7*b*. The fixing roller 7*a* and pressure roller 7*b* may typically be at temperatures of 150°–170° C.

Such a background device suffers from a significant drawback in that the heat from the fixing roller 7*a* or the pressure roller 7*b*, particularly when the device is not in operation and is in a stand-by mode, has a negative influence on the toner in the developing units 22 and stored in the toner cartridges 42.

In such a device, the fixing roller 7*a* and pressure roller 7*b* are maintained at a high temperature even when an image forming device is not operating. When the device is in operation, i.e., not in the stand-by mode, the revolver developing unit 4 rotates, and thus no developing unit 22 or toner cartridge 42 absorbs heat from the fixing unit 7 for a significant period of time.

More specifically, as shown by the arrows in FIG. 12, heat from the fixing roller 7*a* and the pressure roller 7*b* is transferred to the toner cartridges 42 and the developing units 22. Particularly, the nearest toner cartridge and the nearest developing unit, in the example shown in FIG. 12, toner cartridge 42Y and developing unit 22Y, absorb heat from the fixing roller 7*a* and pressure roller 7*b*.

In this way, the temperature of the specific toner in the nearest toner cartridge 42Y and the nearest developing unit 22Y increases. As a result, a developing condition of the toner stored in the toner cartridge 42Y and developing unit 22Y changes, which has an adverse influence on the subsequent image forming operation which utilizes the toner stored in cartridge 42Y and developing unit 22Y. As a result of the exposure to the heat, the quality of the toner itself deteriorates, and the toner may even become caked into the cartridge 42Y and the developing unit 22Y.

SUMMARY OF THE INVENTION

Accordingly, one object of the present invention is to provide a novel image forming apparatus which overcomes the above-discussed drawbacks in the background image forming apparatus.

One more specific object of the present invention is to provide a novel image forming apparatus which includes a revolver type developer, which prevents toner stored within the revolver type developer from being adversely influenced by heat from a fixing unit.

In order to achieve such objectives of the present invention, as one feature in the present invention the revolver developing unit is intermittently rotated when the image forming apparatus is in a stand-by state.

As a further feature of the present invention, the revolver developing unit of the present invention may be rotated at a very slow continuous speed when the image forming apparatus is in a stand-by state.

As a further feature of the present invention, the intermittent rotation and the slow continuous rotation of the revolver developing unit can be stopped if the temperature of the fixing unit falls below a predetermined value.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
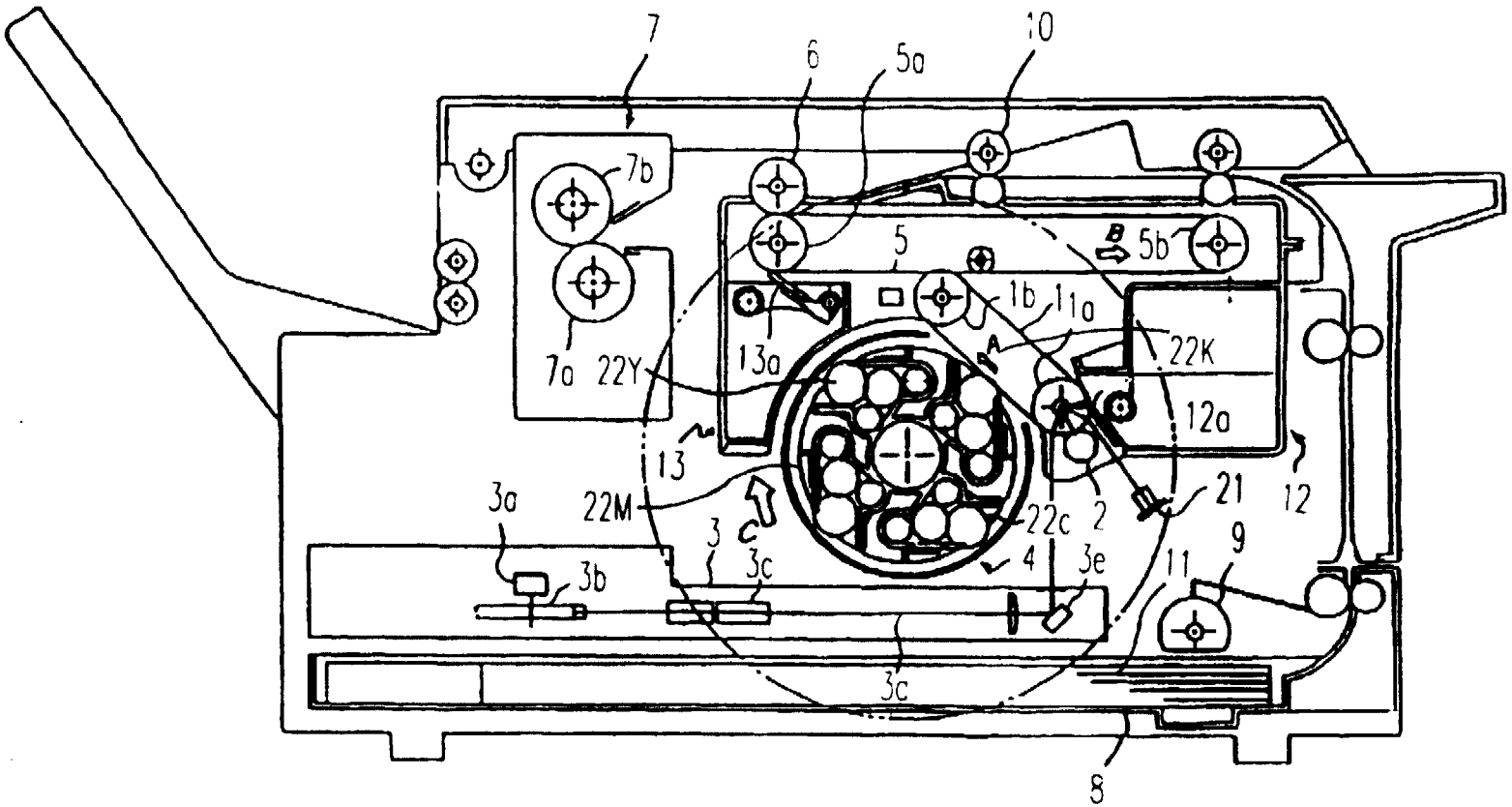
FIG. 1 shows an image forming apparatus to which the system of the present invention can be applied.

Referring now to the drawings, wherein like reference numerals designate identical or corresponding parts throughout the several views, and more particularly to FIG. 1 of the present specification, there is shown an image forming apparatus to which the present invention may be applied.

Referring to FIG. 1, an image forming apparatus using a revolver type developing device which can implement the control operations of the present invention is shown and implemented as a full-color printer by way of example. As shown, the printer has a photoconductive element, or image carrier, in the form of a belt 1, or in the form of a drum (not shown). The belt 1 is supported by rollers 1*a* and 1*b*. After a charge roller 2 has uniformly charged the surface of the belt 1, laser optics 3 scan the charged surface in accordance with image data, to thereby form an electrostatic latent image on the belt 1. The words "image data" refer to each of color image data produced by separating a desired full-color image into, as an example, yellow, magenta, cyan and black components. A revolver type developing device 4 sequentially develops the individual latent images with toners or developers of the corresponding colors, i.e., yellow, magenta, cyan and black toners. As a result, toner images of the respective colors are sequentially formed on the belt 1.

The photoconductive belt 1 is rotated in a direction indicated by an arrow A in FIG. 1. An intermediate transfer belt 5 is rotated in synchronism with the belt 1 in a direction B, also shown in FIG. 1. Intermediate transfer belt. 5 is supported by rollers 5*a* and 5*b*. The yellow, magenta, cyan and black toner images formed on the belt 1 by the above procedure are sequentially transferred to the intermediate transfer belt 5 one above the other. A sheet of paper or similar recording medium 11 is fed from a tray 8 to an image transfer position by a pick-up roller 9 and a registration roller 10. The composite color image on the intermediate transfer belt 5 is then transferred to the recording medium 11 at an image transfer position. A fixing unit 7, which includes fixing roller 7*a* and pressure roller 7*b*, fixes the toner image on the recording medium 11 to complete a full-color image formation. After the image transfer, the toner remaining on the belt 1 is removed by a cleaner 12, which includes cleaning blade 12*a*, assigned to the belt 1. Similarly, the toner remaining on the belt 5 is removed by an exclusive cleaner 13, which includes cleaning blade 13*a*.

Figure 2:
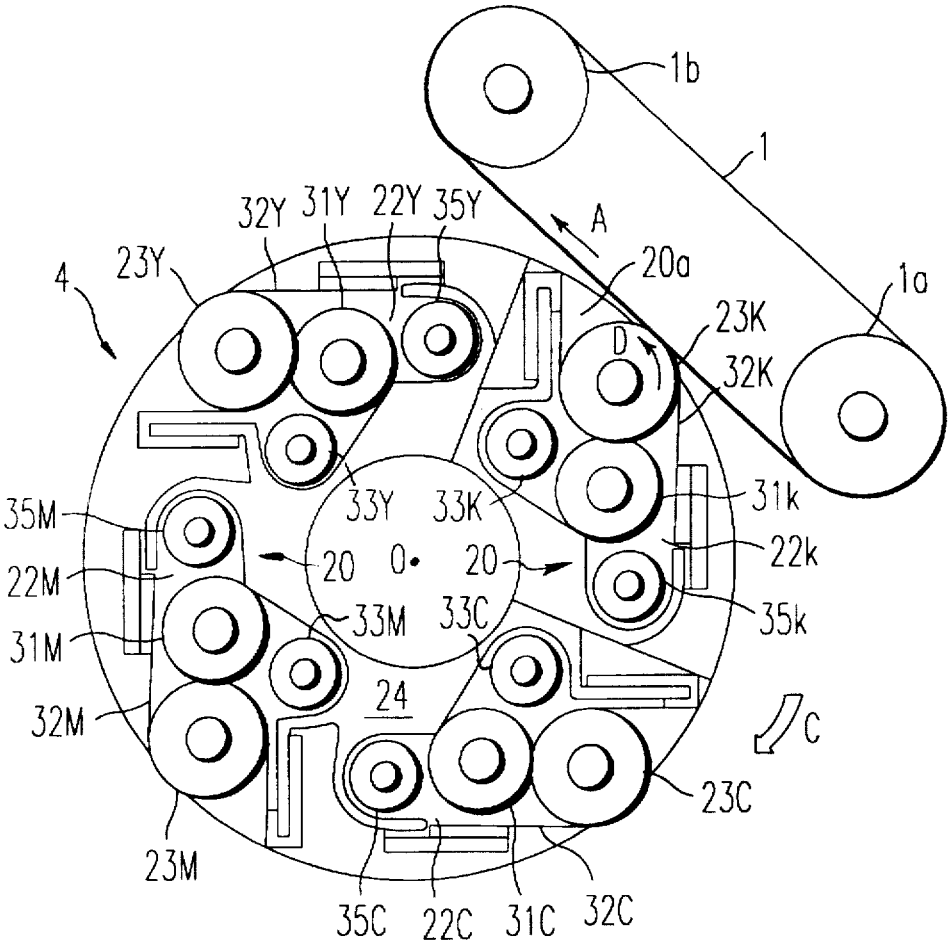
FIG. 2 shows specific features of a revolver developing unit of the image forming apparatus of FIG. 1.
Figure 3:
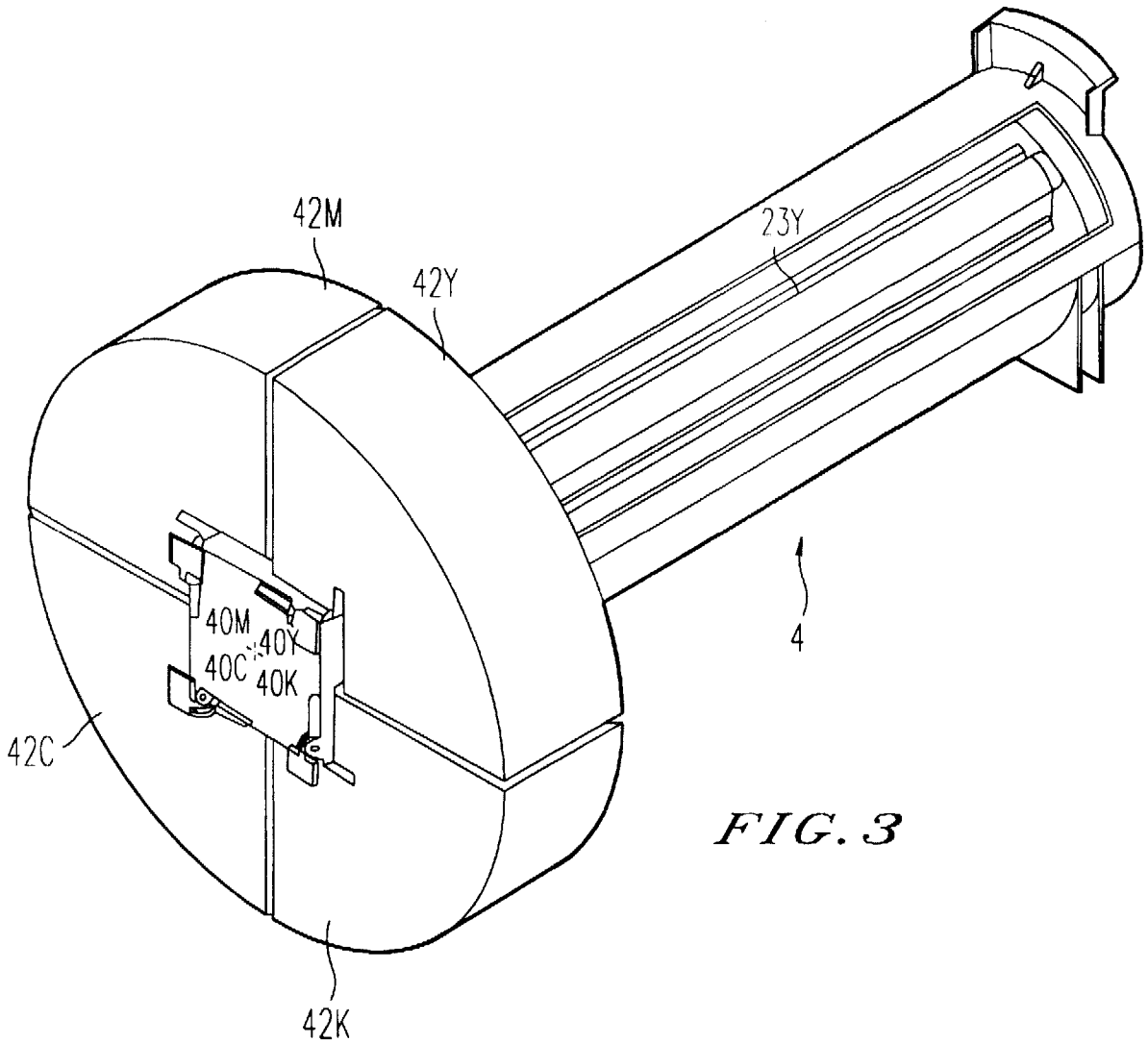
FIG. 3 shows specific features of the image forming apparatus of FIGS. 1 and 2.

As shown in FIG. 2, the revolver developing unit 4 is located in the vicinity of the photoconductive belt 1 and has a yellow developing unit 22Y, a magenta developing unit 22M, a cyan developing unit 22C, and a black developing unit 22K. The yellow developing unit 22Y is shown as being located at a developing position by way of example. A casing, or rotatable body, 20 is rotatable about a shaft O in a direction indicated by an arrow C. In this sense, the shaft O defines the axis of rotation of the casing 20. A drive mechanism, not shown, is drivably connected to the casing 20. The casing 20 is partitioned into four compartments which constitute the developing units 22Y, 22M, 22C and 22K, respectively.

The developing units 22Y, 22M, 22C and 22K respectively store yellow, magenta, cyan and black toners, each of which may be a nonmagnetic one-component type developer. Developing rollers, or developer carriers, 23Y, 23M, 23C and 23K are disposed in the developing units 22Y, 22M, 22C and 22K, respectively. The developing rollers 23Y–23K are selectively exposed to the outside via respective openings 22*a* formed through the casing 20. Rollers 31, 33, 35 and blade 32 are also included in each developing unit 22.

In operation, the revolver developing unit 4 is rotated about the shaft O such that the developing units 22Y–22K are selectively brought to the developing position in synchronism with their respective color data. At the developing position, the developing units 22Y–22K cause the respective developing rollers 23Y–23K to rotate in a direction D, thereby developing associated latent images sequentially formed on the belt 1. The resulting toner images are sequentially transferred to the intermediate transfer belt 5, and then to the recording medium 11 one above the other to generate a full-color image, as stated earlier.

In FIG. 3, 42Y, 42M, 42C and 42K are toner cartridges respectively removably mounted to the toner chambers 40Y, 40M, 40C and 40K of the respective developing units 22Y, 22M, 22C and 22K. When the revolver developing unit 4 is newly mounted to the printer or when the cartridges 42Y–42K run out of toner, the cartridges 42Y–42K are mounted or replaced. Hence, a necessary amount of toner is stored in each of the toner chambers 40Y–40K at all times. Toner cartridges 42 can also be formed separately from developing units 22.

Figure 4:
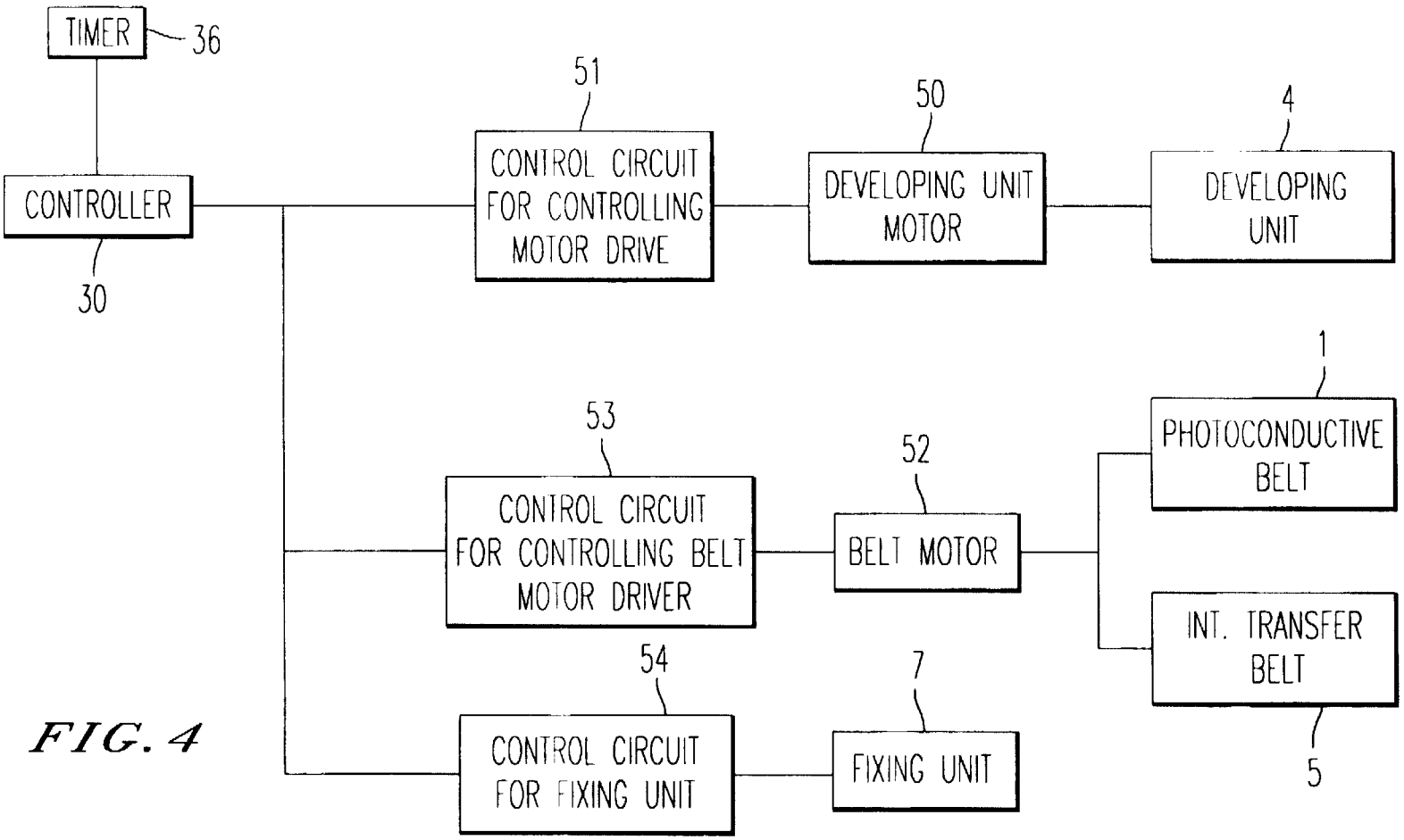
FIG. 4 shows a first embodiment of control circuitry of the present invention.

A control system of a first embodiment of the present invention will now be explained with reference to FIG. 4. FIG. 4 shows certain controllers for the revolver developing unit 4 and fixing unit 7 among controllers of the entire copy machine. A control device 30 also controls other units not shown in FIG. 4.

The revolver developing unit 4 is driven by a developing unit motor 50. A control circuit 51 for controlling the developing unit motor 50 controls the motor 50 by a signal from control device 30. A belt motor 52 is a motor which drives the photoconductive belt 1 and the intermediate transfer belt 5. A controller circuit 53 controls the belt motor 52 to rotate the photoconductive belt 1 and intermediate transfer belt 5. The controller circuit 53 controls the rotation of the photoconductive belt 1 and intermediate transfer belt 5 based on a signal from the control device 30. The control device 30 also sends a control signal to a control circuit 54, which controls the fixing unit 7. This control circuit 54 controls temperatures of the fixing roller 7*a* and the pressure roller 7*b* in the fixing unit 7 and controls rotation of the rollers 7*a*, 7*b* according to a signal from control device 30.

Figure 5:
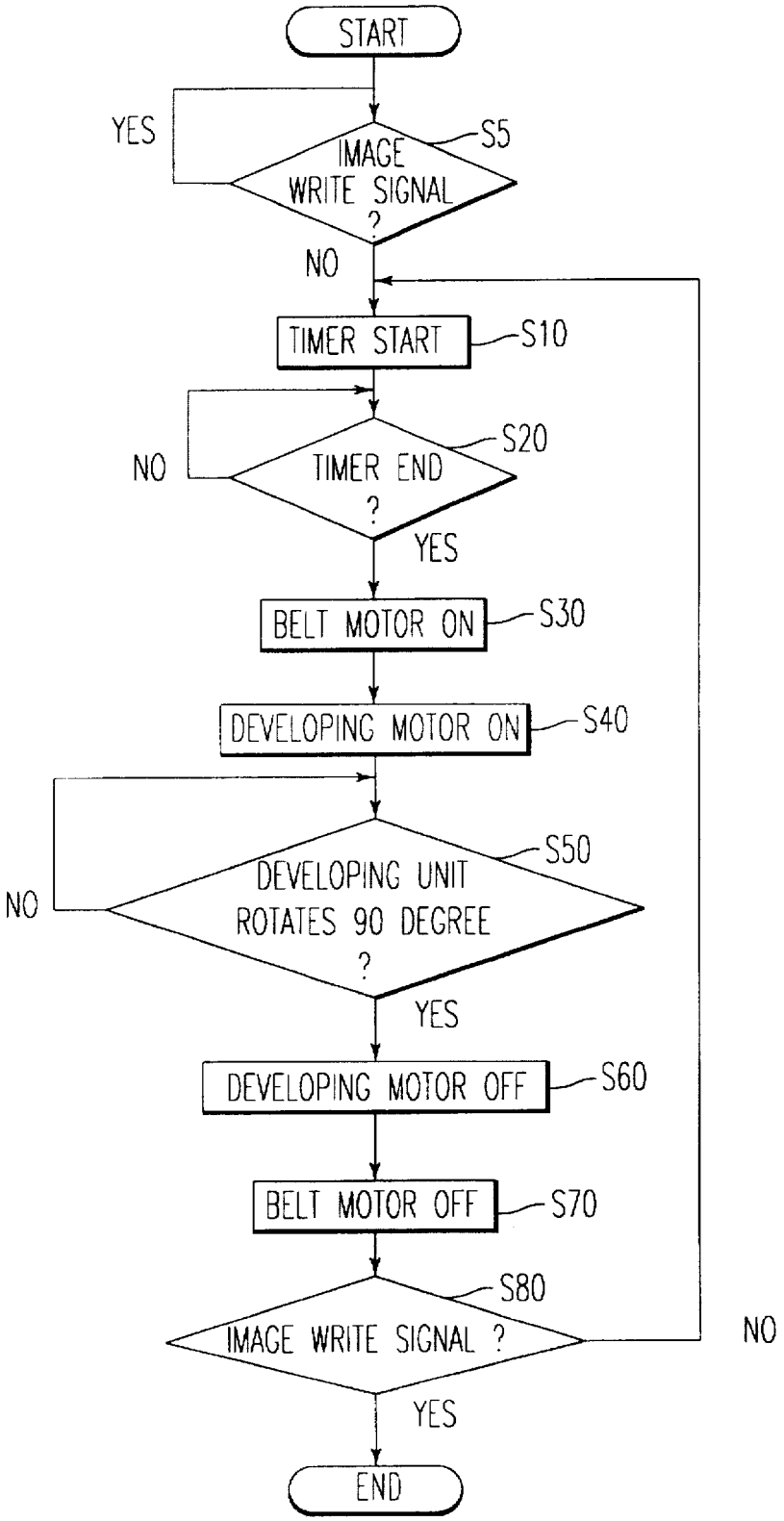
FIG. 5 shows a flowchart of a control operation of the present invention.

FIG. 5 is a flowchart which shows a control operation of a first embodiment of the present invention. In the image forming device of FIG. 1, during a waiting time or stand-by mode during which image formation does not take place, each developing unit 22 of the revolver developing unit 4 is at a fixed position, and the photoconductive belt 1 and the intermediate transfer belt 5 do not rotate. Further, since the temperature of the fixing roller 7*a* and pressure roller 7*b* in the fixing unit 7 cannot be suddenly raised, the fixing roller 7*a* and pressure roller 7*b* are controlled to be maintained at a high temperature even in the stand-by mode.

In this first embodiment of the present invention, the present invention has an operation to intermittently rotate the revolver developing unit 4 so that heat from the fixing unit 7 does not influence only one developing unit 22, but instead has its influence spread out to each of the developing units 22. This spreading out of the heat in the present invention prevents toner in any of the developing units 22 from being adversely affected by limiting the exposure time of the toner in each of the developing units 22 to the heat from the fixing unit 7.

As shown in FIG. 5, after a start operation of the image forming apparatus, it is first determined whether an image write signal is detected in step S5. When an image write signal is not detected as indicated in step S5, the timer 36 starts in step S10. This operation of starting the timer in step S10 determines whether the image forming apparatus is to be put into the stand-by mode. When the timer ends in step S20, which for example may be after a predetermined period of time of 5 minutes, it is determined that the image forming apparatus should be set in a stand-by mode.

After the timer ends in step S20, in step S30 the belt motor 52 is turned on and the photoconductive belt 1 is rotated. This step S30 is an optional step in this operation of the present invention. Photoconductive belt 30 may be rotated to avoid damage to photoconductive belt 30 which may arise by photoconductive belt 1 contacting the same point of the developing unit 22. By periodically rotating photoconductive belt 1, the portion of photoconductive belt 1 which contacts the developing unit 22 can be changed, and this can thereby avoid damage to photoconductive belt 1.

After the photoconductive belt 1 is rotated in step S30, the developing unit motor 50 is turned on in step S40, and the revolver developing unit 4 is thus rotated. The revolver developing unit 4 is rotated a total of 90° as indicated in step S50. This 90° rotation allows a next developing unit 22 to be rotated to the position where this next developing unit 22 and toner cartridge 42 mainly absorbs heat from the fixing unit 7. This operation of the present invention allows each of the different developing units 22 and toner cartridges 42 to absorb a certain amount of heat from the fixing unit 7. However, by intermittently rotating the revolver developing unit 4 periodically, no developing unit 22 or toner cartridge 42 absorbs enough heat to have an adverse influence on the toner stored therein.

The system then proceeds to steps S60 and S70 where the developing motor 50 and belt motor 52 are respectively turned off after the 90° rotation of revolver developing unit 4. In step S80 the system again determines whether an image write signal is present. If an image write signal is present, the system ends, the timer 36 is stopped, and the belt 1 and developing unit 4 are no longer intermittently rotated. If no image write signal is present, the system returns to step S10 and the intermittent rotation operation of belt 1 and developing unit 4 continues.

With this operation in the present invention, based upon each timer ending period, which as noted above may be a 5 minute time period, the revolver developing unit 4 rotates 90°.

In this way, the revolver developing unit 4 rotates intermittently every predetermined time period (e.g. every 5 minutes) during the stand-by mode. As a result, heat from the fixing unit 7 is prevented from adversely influencing a specified developing unit 22 or a specified toner cartridge 42 in the revolver developing unit 4. As a result, the temperatures of the toner inside the specified devices is kept at an acceptable level. Further, the developing environment is also maintained at a level as in an initial state. Thus, toner deterioration and toner caking caused by heat from the fixing unit 7 is prevented, and as a result, a good quality image can be obtained.

As noted above, in the first embodiment of the present invention the optional step of the photosensitive belt 1 also rotating together with the revolver developing unit 4 are provided. As also noted above, this prevents damage to the photoconductive belt 1. A further benefit is also achieved. Assume that the developing roller 23K of the black developing unit 22K contacts the photoconductive belt 1 by rotation of the developing unit 4. Even if the black toner of the developing roller 23K sticks to the photoconductive belt 1, by virtue of the intermittent rotation of the photoconductive belt 1 the next yellow developing unit 22Y contacts a different surface of the belt 1 from the surface on which the black toner was stuck. Accordingly, the black toner does not enter into the next yellow developing unit 22Y. As a result, mixing of the different toners is prevented. Additionally, there is another advantage that a temperature of the belt 1 itself can be maintained uniform by the above rotation of the photoconductive belt 1. As noted above, the steps S30 and S70 of FIG. 5 are optional, and the present invention can function without such steps.

Figure 6:
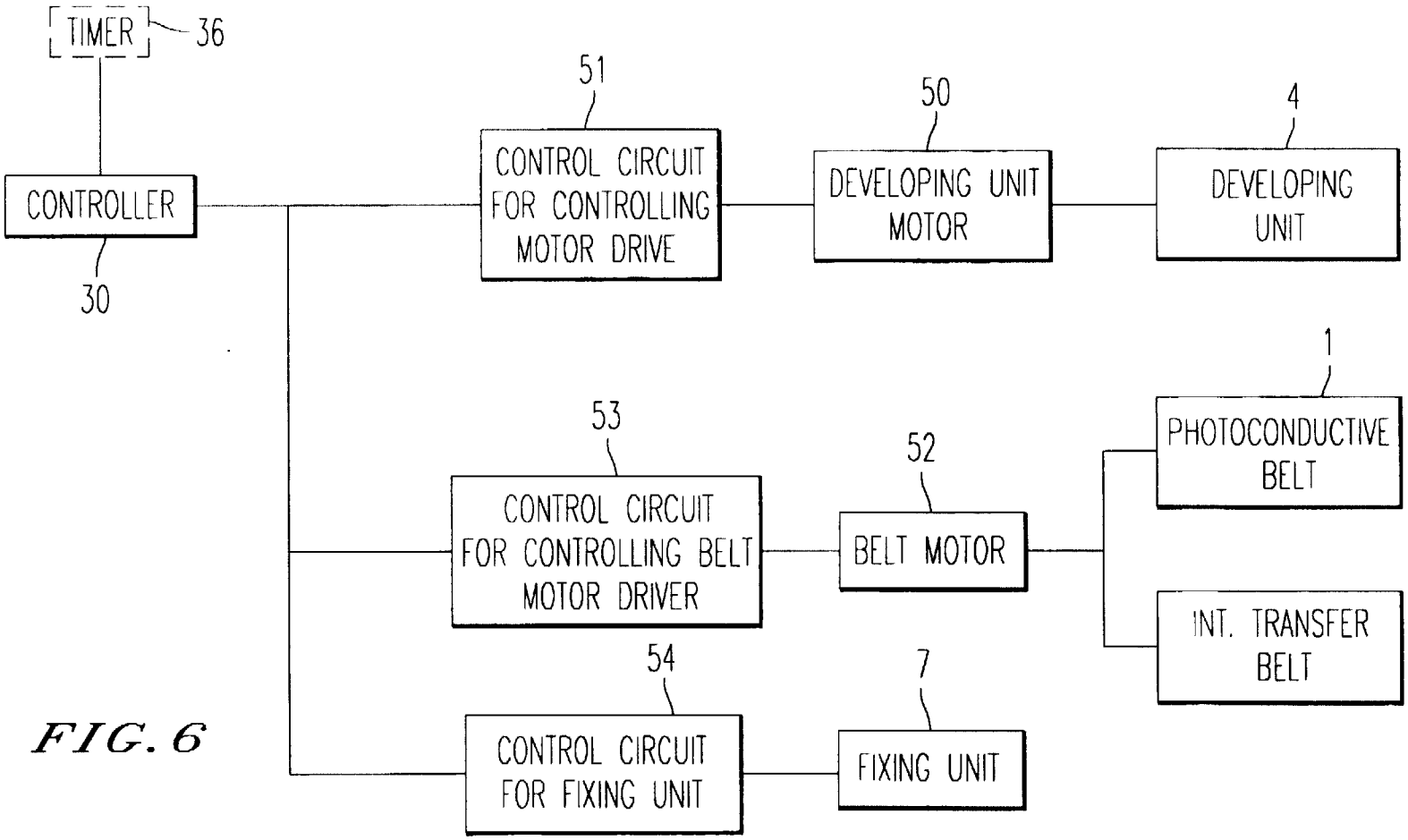
FIG. 6 shows a second embodiment of control circuitry of the present invention.

FIG. 6 shows a second embodiment of the present invention. A structure of this second embodiment is similar to the first embodiment, except that timer 36 may be optional in this second embodiment.

Figure 7:
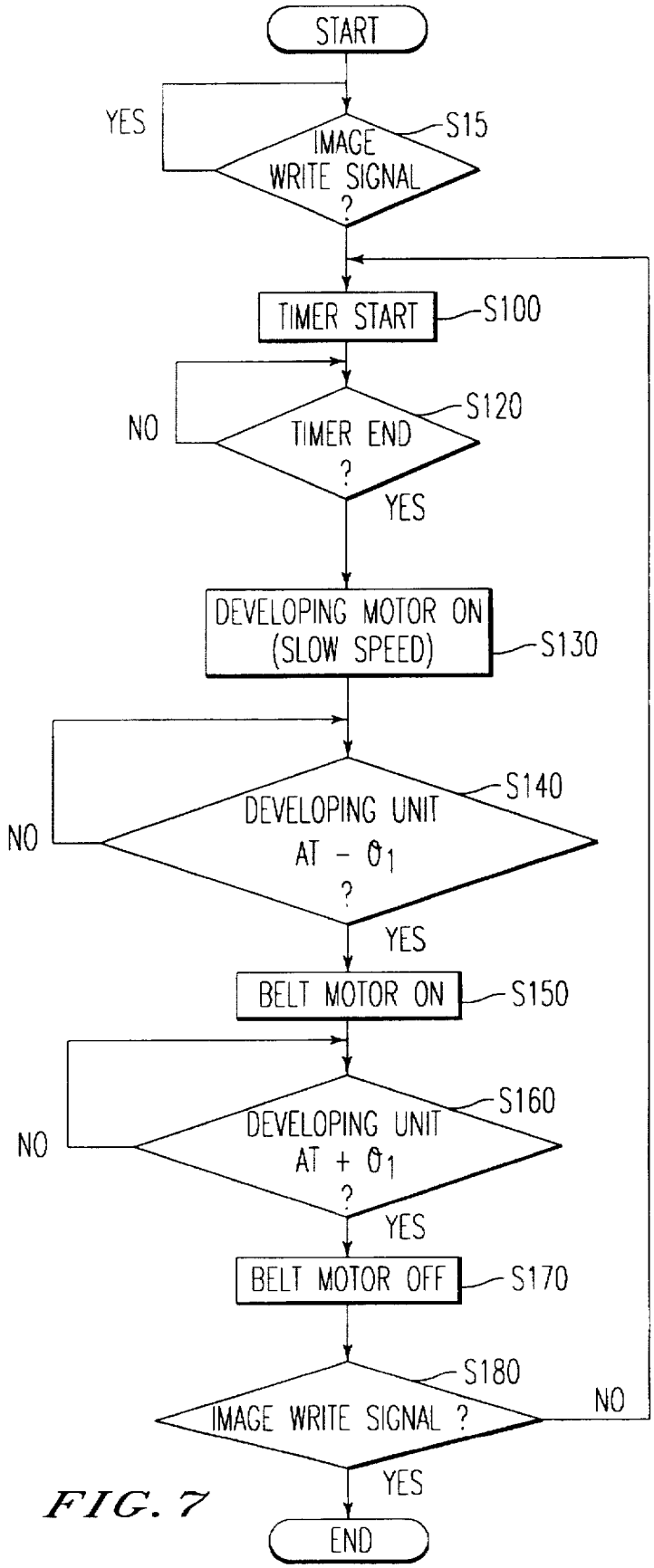
FIG. 7 shows a flowchart of a further control operation of the present invention.

FIG. 7 is a flowchart which shows a control operation of this second embodiment of the present invention. This second embodiment operates to rotate the revolver developing unit 4 at a constant low speed during the stand-by mode of the copy machine.

As shown in FIG. 7, in this second embodiment of the present invention an image write signal is first detected in step S15, a timer is started in step S100 if no image write signal is detected, and then it is determined whether the timer ends in step S120. As discussed above with respect to the embodiment of FIG. 5, this operation essentially determines whether the image forming apparatus is in a standby mode.

In the operation of the present invention as discussed above, an operation of a timer is utilized to determine when the image forming apparatus enters the stand-by mode. However, other ways of determining when a device enters a stand-by mode can also be utilized. If another method is utilized to determine whether the system is in the stand-by mode, the timer 36 shown in FIG. 6 can be deleted and steps S100 and S120 can be omitted.

After the system has determined that the image forming apparatus is in the stand-by mode, the developing unit motor 50 is turned on and the revolver developing unit 4 is rotated, see step S130. In this operation of the present invention, the revolver developing unit 4 is rotated at a slow constant speed. This rotation of the revolver developing unit 4 at the slow speed ensures that none of the individual developing units 22 or toner cartridges 42 absorbs heat from the fixing unit 7 for an extended period of time.

The operation of the present invention as shown in FIG. 7 may also include a further operation of moving the photoconductive belt 1, to avoid damage to the photoconductive belt 1 as discussed above. In this operation of the present invention, the photoconductive belt 1 is only moved for a small period of time during the rotation of the revolver developing unit 4. This small period of time is the period of time when a developing roller 23 of each of the developing units 22 contacts the photoconductive belt 1. The photoconductive belt 1 need only be moved at these times because it is the contact between the developing roller 22 and the photoconductive drum 1 which may cause problems on the photoconductive drum 1.

As shown in FIG. 7, when the developing unit reaches a particular point $-\theta_1$, as determined in step S140, the belt motor 52 is turned on at step S150. The belt motor is then turned off at step S170 when the developing unit reaches a further point $+\theta_1$ at step S160. This point $-\theta_1$ is the point where the developing roller 23 of the developing unit 22 comes in contact with the photoconductive belt 1, and the point $+\theta_1$ is the point where the developing roller 23 leaves contact with the developing belt 1. The system of the present invention shown in FIG. 7 then again determines whether an image write signal is present in step S180, and if no image write signal is present the system proceeds back to step S140.

Figure 8A:
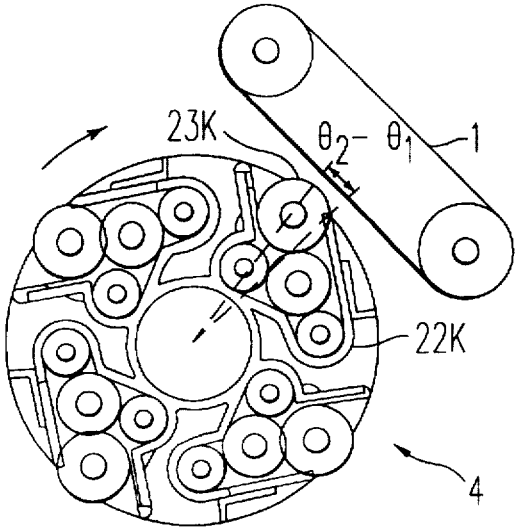
FIG. 8 explains an operation in the device of the present invention.
Figure 8B:
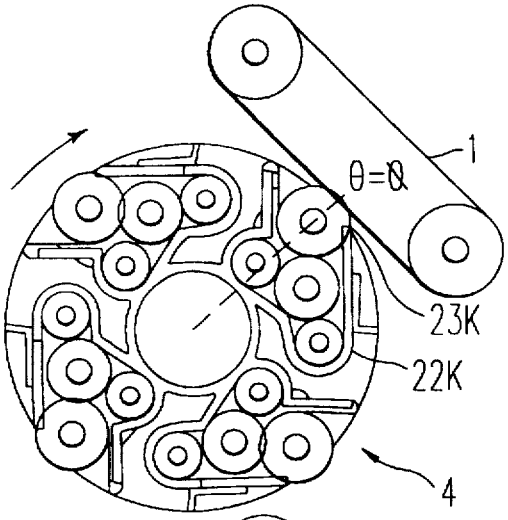
Figure 8C:
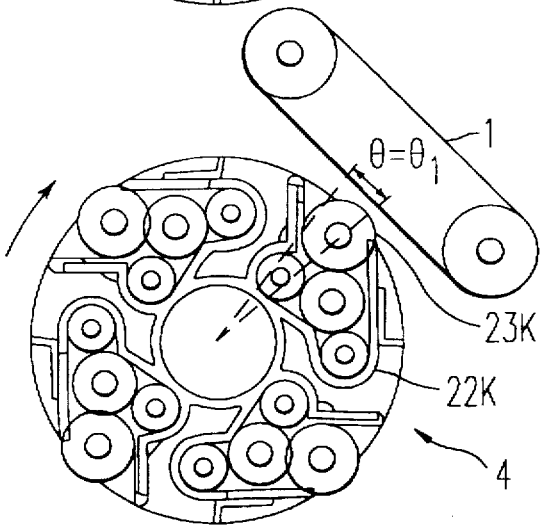

FIG. 8 shows the state of rotation of developing unit 22 as discussed above with respect to FIG. 7. FIG. 8(*a*) shows a state before when the developing roller 23K of the developing unit 22K comes in contact with surface of the photoconductive belt 1 (an angle $\theta=(-\theta_1)$. FIG. 8(*b*) shows a state when developing roller 23K contacts photoconductive belt 1. FIG. 8(*c*) shows a state just after the developing roller 23K leaves contact with the surface of the photoconductive belt 1 with $\theta=(+\theta_1)$. As discussed above, in this operation of the present invention, when the developing unit rotates from $(-\theta_1)$ to $(+\theta_1)$, the photoconductive belt 1 also rotates.

As discussed above, the belt motor 52 is not started until unit 22K is located at the position shown in FIG. 8(*a*). When the developing unit 22 is located at the position shown in FIG. 8(*a*), the belt motor 52 starts to be driven, step S150, and the photoconductive belt 1 starts to move. The photoconductive belt 1 is then moved from the position shown in FIG. 8(*b*) to the position shown in FIG. 8(*c*). When the developing unit 23K comes to the position of FIG. 8(*c*), the belt motor 52 stops rotating, step S170.

According to this second embodiment of the present invention, the developing unit 22 does not start to rotate suddenly, because the developing unit 22 rotates at a constant low speed in the stand-by mode. In this embodiment, there is an additional advantage that a noise for resuming the rotation is eliminated and a large electricity consumption necessary for the revolver developing unit 4 to recover to its usual speed is eliminated.

An image forming apparatus may also feature an energy saving mode to save electricity consumption when there is no write image command for a predetermined period of time. Turning off the heaters in fixing unit 7 contributes to saving electricity consumption. Accordingly, in an energy saving mode, the heater for the fixing unit 7 may be turned OFF.

Figure 9:
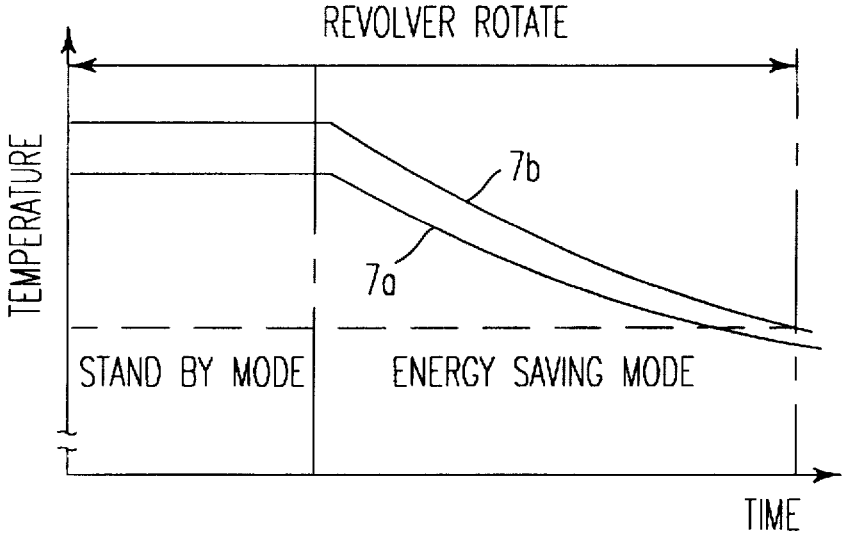
FIG. 9 explains a further feature of the present invention.

FIG. 9 is a graph which shows a condition of a temperature of the pressure roller 7*b* and the fixing roller 7*a* in the stand-by mode versus time. The line 7*a* shows a temperature of the fixing roller 7*a* and the line 7*b* shows a temperature of the pressure roller 7*b*. As shown in FIG. 9, the temperature of the rollers 7*a*, 7*b* in the fixing unit 7 is maintained at a uniform predetermined temperature in the stand-by mode. When a predetermined time has passed, an energy saving mode is activated and the heater in fixing unit 7 is turned off. However, the temperature of the rollers 7*a*, 7*b* in fixing unit 7 does not immediately drop just after the heater is turned off; it takes some time for the temperature to fall.

As a result, even after the energy saving mode is started, the residual heat from fixing unit 7 still influences the revolver developing unit 4 for a period of time. Therefore, the revolver developing unit 4 should still rotate as explained in the first embodiment or in the second embodiment until the temperature of the rollers 7*a*, 7*b* reaches a level that does not adversely influence the toner even in such an energy saving mode. The horizontal dashed line in FIG. 9 shows the temperature to which the roller 7*a*, 7*b* in the fixing unit 7 should fall, at which the temperature rollers 7*a*, 7*b* in the fixing unit 7 does not adversely influence the developing unit by the residual heat.

Figure 10:
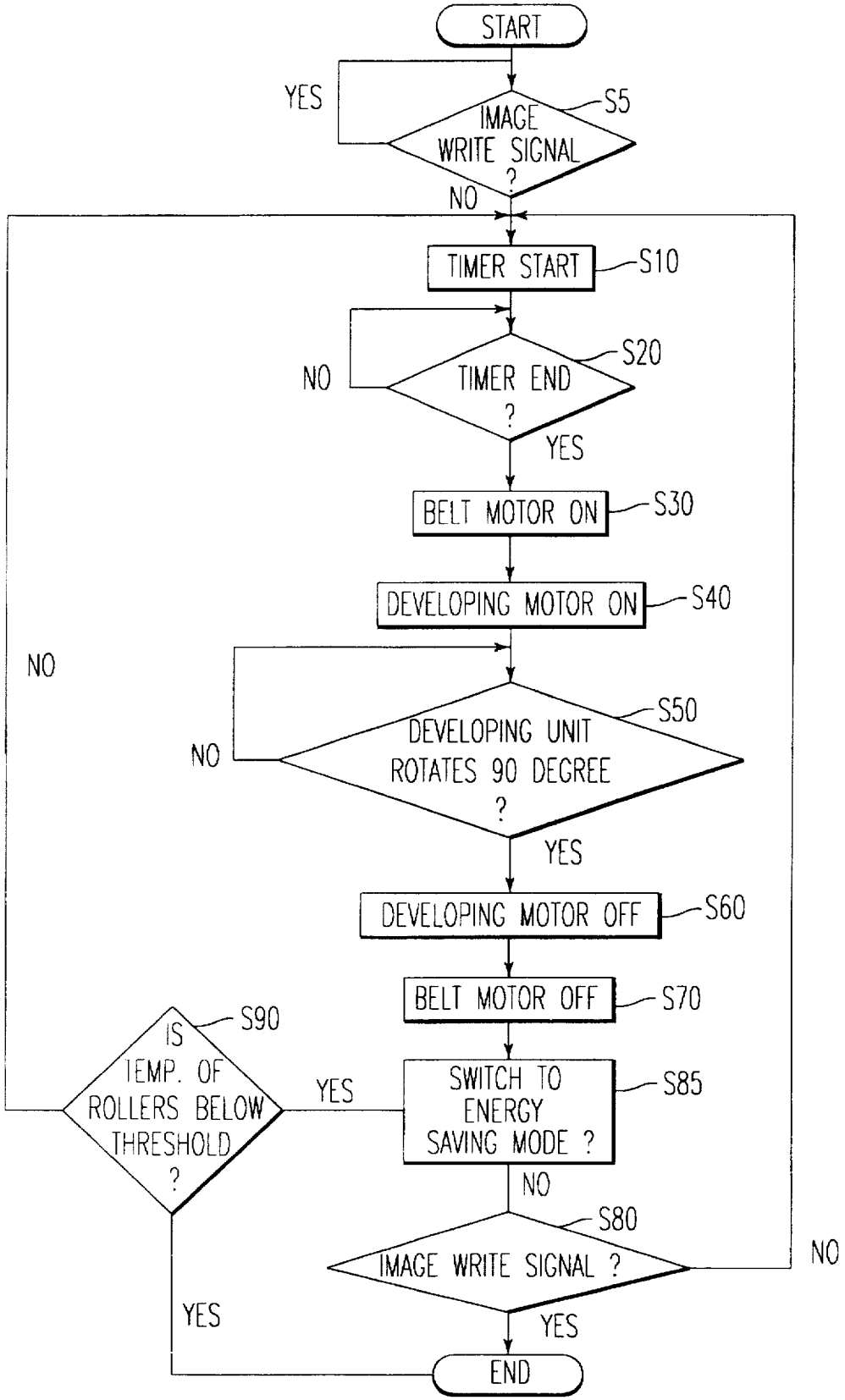
FIG. 10 shows a flowchart of a further control operation of the present invention.
Figure 11:
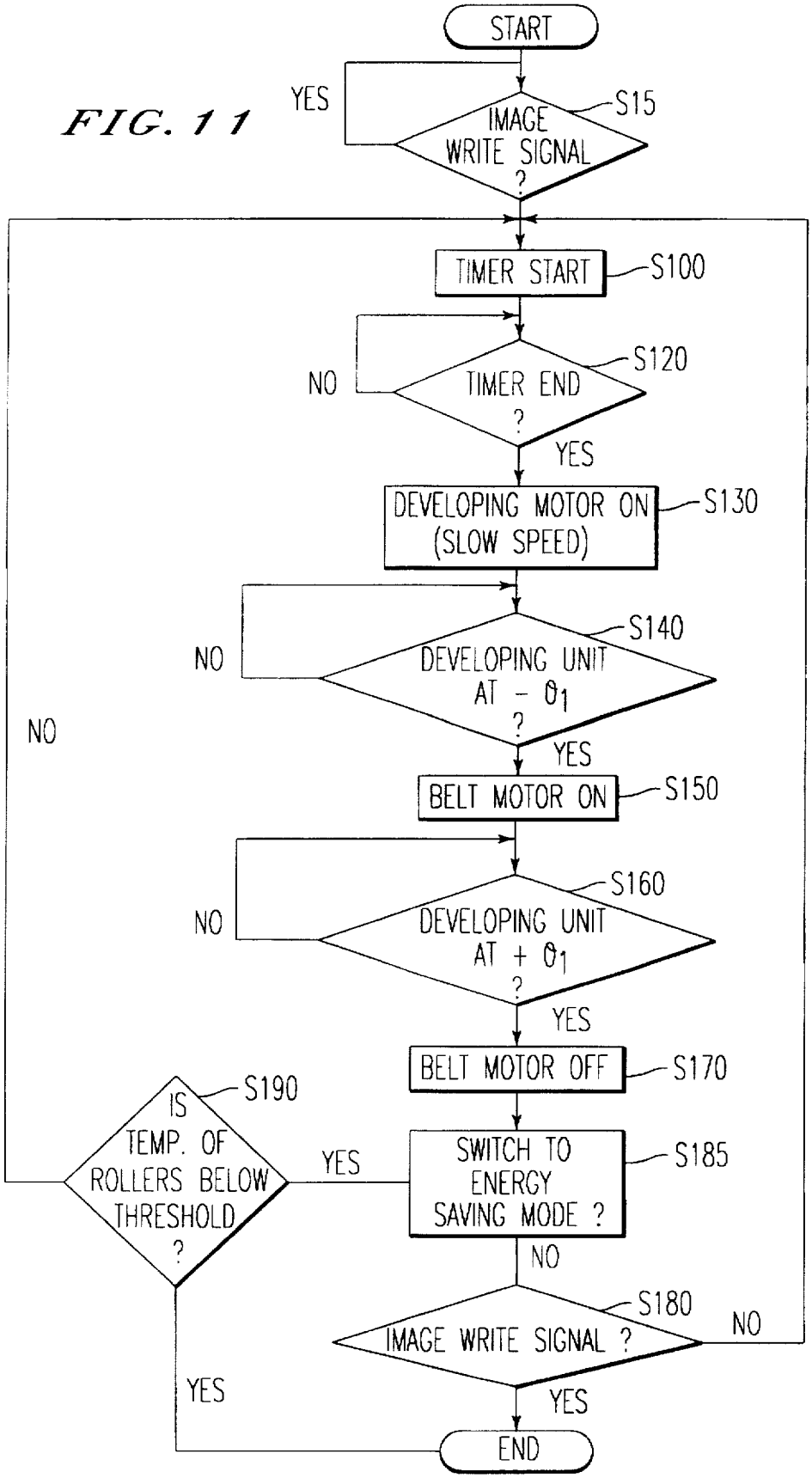
FIG. 11 shows a flowchart of a further control operation of the present invention.

To still provide a beneficial operation when an energy saving mode is implemented as shown in FIG. 9, further embodiments of the present invention as shown in FIGS. 10 and 11 may be implemented.

The further embodiment of the present invention as shown in FIG. 10 is similar to the operation as shown in FIG. 5, except that further steps S85 and S90 are implemented. In this operation of the present invention as shown in FIG. 10, after the belt motor is turned OFF in step S70, it is determined whether the system of the present invention has switched to the energy saving mode. This switching to the energy saving mode takes place after a predetermined period of time in the stand-by mode, as shown in FIG. 9. If the system has switched to the energy saving mode, i.e. YES in step S85, it is then determined in step S90 whether the temperature of the rollers 7*a*, 7*b* is below a predetermined threshold temperature, i.e., below the dashed line shown in FIG. 9. This calculation can be determined by either actually measuring the temperature of the rollers 7*a* and 7*b*, or by assuming that the temperature of the rollers 7*a* and 7*b* falls below this threshold temperature represented by the dashed line in FIG. 9 after a predetermined period of time after switching to the energy saving mode. If it is determined that the temperature is below the threshold temperature, i.e., YES in step S90, then the operation of the present invention ends and the photoconductive belt 1 and revolver developing unit 4 are no longer intermittently rotated. If the temperature is not below the threshold level, i.e., NO in step S90, then the system returns to step S10.

Figure 12:
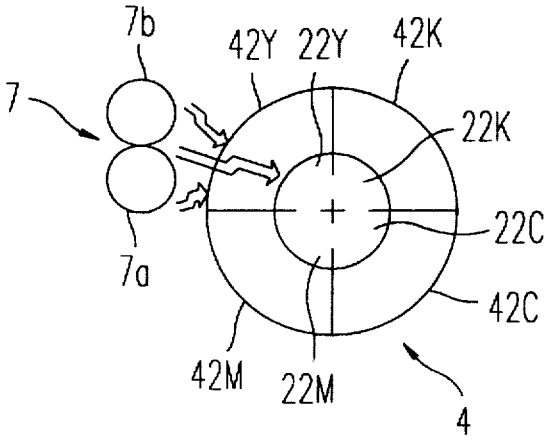
FIG. 12 BACKGROUND ART
FIG. 12 shows a background device.

FIG. 11 shows a further embodiment of the present invention which is similar to the embodiment shown in FIG. 7, except that further steps S185 and S195 are provided, which correspond to steps S85 and S90 as discussed above with respect to FIG. 11. In this embodiment of FIG. 12, if the image forming apparatus has switched to the energy saving mode, i.e., YES in step S185, and if the temperatures of the rollers 7*a* and 7*b* are below the threshold temperature, i.e., YES in step S90, then the control operation of the present invention is ended and the photoconductive belt 1 and revolver developing unit 4 are no longer rotated. Alternatively, the system proceeds with its operation of rotating the revolver developing unit 4 at a slow constant speed and periodically rotating the photoconductive belt 1 if no in step S190.

Obviously, numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. An image forming device including a revolver developing unit, comprising:

a first controller for detecting a presence of an image write signal in the image forming device;

a second controller for rotating said revolver developing unit when the first controller initially detects the presence of the image write signal and then does not detect the presence of the image write signal for a predetermined timing, wherein the second controller continuously rotates said revolver developing unit when the first controller does not detect the presence of the image write signal for the predetermined timing;

a photosensitive belt to contact the revolver developing unit;

a third controller for driving said photosensitive belt when the first controller does not detect the presence of the image write signal; and wherein the third controller drives said photosensitive belt for a predetermined period prior to the developing roller contacting the photosensitive belt to the predetermined period after the developing roller contacts the photosensitive belt.

2. A method for image formation by an image forming device including a revolver developing unit, comprising the steps of:

detecting a presence of an image write signal in the image forming device;

rotating said revolver developing unit when the presence of the image write signal is not detected for a predetermined timing after initially detecting the presence of the image write signal, wherein the step of rotating said revolver developing unit continuously rotates said revolver developing unit when the first controller does not detect the presence of the image write signal for the predetermined timing;

driving said photosensitive belt when the first controller does not detect the presence of the image write signal; and wherein said photosensitive belt is driven for a predetermined period prior to the revolving developing unit contacting the photosensitive belt to the predetermined period after the revolving developing unit contacts the photosensitive belt.

3. An image forming device including a revolver developing unit, a fixing roller and a pressure roller, comprising:

a first controller for detecting a presence of an image write signal in the image forming device;

a second controller for rotating said revolver developing unit when the first controller does not detect the presence of the image write signal; and means for determining if a temperature of both the fixing roller and the pressure roller are below a predetermined threshold; and wherein operation of the second controller is stopped if the determining means determines that the temperature of both the fixing roller and the pressure roller are below the predetermined threshold.

4. The image forming device according to claim 3, wherein the second controller rotates said revolver developing unit intermittently at a predetermined timing when the first controller does not detect the presence of the image write signal for a predetermined timing.

5. The image forming device according to claim 3, wherein the second controller continuously rotates said revolver developing unit when the first controller does not detect the presence of the image write signal.

6. The image forming device according to claim 3, wherein the second controller continuously rotates said revolver developing unit when the first controller does not detect the presence of the image write signal for a predetermined timing.

7. The image forming apparatus according to claim 3, wherein the image forming device further includes a photosensitive belt to contact the revolver developing unit, and further comprising:

a third controller for driving said photosensitive belt when the first controller does not detect the presence of the image write signal.

8. The image forming device according to claim 7, wherein the third controller drives said photosensitive belt intermittently at the predetermined timing when the first controller does not detect the presence of the image write signal for a predetermined timing.

9. The image forming device according to claim 3, wherein the third controller drives said photosensitive belt for a predetermined period prior to the developing roller contacting the photosensitive belt to the predetermined period after the developing roller contacts the photosensitive belt.

10. An image forming device including a revolver developing unit and a photosensitive belt to contact the revolver developing unit, comprising:

a first controller for detecting a presence of an image write signal in the image forming device;

a second controller for rotating said revolver developing unit when the first controller does not detect the presence of the image write signal, wherein the second controller rotates said revolver developing unit intermittently at a predetermined timing when the first controller does not detect the presence of the image write signal for a predetermined timing;

a third controller for driving said photosensitive belt when the first controller does not detect the presence of the image write signal, wherein the third controller drives said photosensitive belt intermittently at the predetermined timing when the first controller does not detect the presence of the image write signal for the predetermined timing, and wherein the third controller drives said photosensitive belt for a predetermined period prior to the developing roller contacting the photosensitive belt to the predetermined period after the developing roller contacts the photosensitive belt.

11. The method of image formation according to claim 10, further comprising the step of:

driving said photosensitive belt when the first controller does not detect the presence of the image write signal.

12. A method for image formation by an image forming device including a revolver developing unit, comprising the steps of:

detecting a presence of an image write signal in the image forming device;

rotating said revolver developing unit when the presence of the image write signal is not detected;

determining if a temperature of both a fixing roller and a pressure roller are below a predetermined threshold; and stopping operation of the second controller if the determining means determines that the temperature of both the fixing roller and the pressure roller are below the predetermined threshold.

13. The method for image formation according to claim 12, wherein the step of rotating said revolver developing unit intermittently rotates said revolver developing unit at a predetermined timing when the first controller does not detect the presence of the image write signal for a predetermined timing.

14. The method of image formation according to claim 12, wherein the step of rotating said revolver developing unit continuously rotates said revolver developing unit when the first controller does not detect the presence of the image write signal.

15. The method of image formation according to claim 12, wherein the step of rotating said revolver developing unit continuously rotates said revolver developing unit when the first controller does not detect the presence of the image write signal for a predetermined timing.

16. The method of image formation according to claim 12, further comprising the step of:

driving a photosensitive belt when the first controller does not detect the presence of the image write signal.

17. The method of image formation according to claim 16, wherein said photosensitive belt is driven intermittently at the predetermined timing when the first controller does not detect the presence of the image write signal for a predetermined timing.

18. The method of image formation according to claim 12, wherein said photosensitive belt is driven for a predetermined period prior to the revolving developing unit contacting the photosensitive belt to the predetermined period after the revolving developing unit contacts the photosensitive belt.

19. A method for image formation by an image forming device including a revolver developing unit, comprising the steps of:

detecting a presence of an image write signal in the image forming device;

rotating said revolver developing unit when the presence of the image write signal is not detected, wherein the step of rotating said revolver developing unit continuously rotates said revolver developing unit when the first controller does not detect the presence of the image write signal; and driving said photosensitive belt when the first controller does not detect the presence of the image write signal, wherein said photosensitive belt is driven for a predetermined period prior to the revolving developing unit contacting the photosensitive belt to the predetermined period after the revolving developing unit contacts the photosensitive belt.

* * * * *